US006547486B1

(12) United States Patent
Jakobsen

(10) Patent No.: US 6,547,486 B1
(45) Date of Patent: Apr. 15, 2003

(54) METHOD FOR COASTAL PROTECTION

(75) Inventor: Poul Jakobsen, Skagen (DK)

(73) Assignee: SIC Skagen Innovationscenter, Skagen (DK)

( * ) Notice: Subject to any disclaimer, the term of this patent is extended or adjusted under 35 U.S.C. 154(b) by 0 days.

(21) Appl. No.: 09/555,257

(22) PCT Filed: Nov. 26, 1998

(86) PCT No.: PCT/DK98/00522

§ 371 (c)(1),
(2), (4) Date: May 26, 2000

(87) PCT Pub. No.: WO99/28559

PCT Pub. Date: Jun. 10, 1999

(30) Foreign Application Priority Data

Nov. 28, 1997 (DK) ..... 1380/97

(51) Int. Cl.[7] ..... E02B 3/04
(52) U.S. Cl. ..... 405/15; 405/74
(58) Field of Search ..... 405/15, 52, 73, 405/74

(56) References Cited

U.S. PATENT DOCUMENTS

| | | | | | |
|---|---|---|---|---|---|
| 4,645,377 | A | * | 2/1987 | Vesterby | 405/74 |
| 4,898,495 | A | * | 2/1990 | Lin | 405/73 |
| 5,061,117 | A | * | 10/1991 | Parks | 405/73 |
| 5,149,227 | A | * | 9/1992 | Parks | 405/73 |
| 5,294,213 | A | * | 3/1994 | Parks | 405/73 |

* cited by examiner

*Primary Examiner*—Robert E. Pezzuto
*Assistant Examiner*—Tara L. Mayo
(74) *Attorney, Agent, or Firm*—Dykema Gossett PLLC

(57) ABSTRACT

In a method for coastal protection, where the coastal area has an underlying freshwater basin and below this a salt water tongue which extends obliquely down into the coastal area, the pressure is equalized in the groundwater basin at least along an area at the shore line completely or partly to the atmosphere through pressure equalization modules, preferably in the form of pipes with a filter at the bottom, which extend down into the groundwater basin. This causes sedimentation of material and thereby an increase in the width of the shore. The resulting sand drift may be utilized for additional building-up of the coastal area by further establishing fascines.

7 Claims, 2 Drawing Sheets

Schematic placing in coastal profile

METHOD FOR COASTAL PROTECTION

BACKGROUND OF THE INVENTION

1. Field of the Invention

The present invention relates to a method for coastal protection where the coastal area has an underlying freshwater basin and below this a salt water tongue which extends obliquely down into the coastal profile.

2. The Prior Art

For coastal protection, it is generally known to build breakwaters of huge stones or concrete blocks which extend from the beach to a distance into the water. Breakwaters are effective, but the costs of construction and maintenance are relatively great. Another coastal protection method is coastal feeding where large amounts of sand are transported to the stretch of coast which is to be protected. This method also involves great costs of construction and maintenance, since large amounts of sand have to be transported. These two methods are still the most widely used coastal protection methods.

In connection with the establishment of intakes for the pumping of sea water for use in salt water aquarias, it was discovered in the early 1980s that sedimentation took place around the intake, which became clogged because of the deposits on top of the intake. This was the incentive for experimenting with a new method for coastal protection, as described in DK 152 301 B. The idea of the method is to pump water from drains established along the shore line, resulting in sedimentation at the drains. However, this method never found extensive use, as it requires a great pumping capacity and consequently high costs of construction and high pump operating costs.

U.S. Pat. No. 5,294,213 discloses a similar system likewise based on drainage pipes established in parallel with the coastal both on the beach and in the water. The operation of the system, which is likewise based on pumping of water, is adapted to the weather, i.e., whether ordinary water level, low water, high water or storm conditions. The system includes a water reservoir into which the water may be pumped through the drainage pipes, and water may be pumped through these into the sea, e.g., to remove sand banks formed by a storm.

A corresponding method is known from U.S. Pat. No. 4,898,495 to keep an inlet, which debouches into the sea, open. This method is likewise based on pumps. The system comprises various diffuser arrangements to remove deposits from the mouth of the inlet by fluidizing these and transporting the material further downstream of the inlet mouth by generating a flow. Sedimentation is carried out downstream of the inlet mouth by pumping water from drains to the diffuser arrangements.

An object of the present invention is to provide a method for coastal protection which is not vitiated by the drawbacks of the known coastal protections.

SUMMARY OF THE INVENTION

This is achieved according to the invention by a method which is characterized in that the pressure of the groundwater basin at least along an area at the shore line is equalized completely or partly through pressure equalization modules, preferably in the form of pipes with a filter at the bottom, which extend down into the groundwater basin.

It has surprisingly been found by the invention that positioning of pressure equalization modules in the beach results in sedimentation of material at the area where the modules are placed.

A possible explanation as to why coastal accretion takes place is that the very fine sand which is fed to the profile partly by the sea and partly by the wind and which is packed with silt and other clay particles, reduces the hydraulic conductivity. Deeper layers in the coastal profile, which have exclusively been built by the waves of the sea, are primarily coarse in the form of gravel and pebbles which have a greater hydraulic conductivity. The difference in hydraulic conductivity will be seen clearly when digging into a coastal profile, it being possible to dig a hole in the profile, and the groundwater will then rise up into the profile once the water table is reached. The reason is the very different hydraulic conductivity and that the freshwater is under pressure from the hinterland. Thus, the coastal profile may be compared to a downwardly open tank where the tank is opened at the top with the pressure equalization modules which extend through the compact layers of the profile so that the water runs more easily and thereby more quickly out of the profile in the period from flood to ebb. This means that a pressure equalized profile is better emptied of freshwater and salt water in the fall period of the tide. When the tide then rises from ebb to flood, a greater fluctuation occurs in the foreshore, as the salt water in the swash zone is drained in the swash zone so that materials settle in the foreshore during this period of time. Conversely, coastal erosion takes place if the freshwater is under pressure in the foreshore, as the salt water will then run back into the sea on top of the freshwater and thereby erode the foreshore. In reality, the pressure equalization modules start a process which spreads from the pressure equalization modules, as the silt and clay particles are flushed out of the foreshore when the fluctuation is increased because of the draining action of the modules. Further, a clear connection has been found between the amount of sediment transport on the coast and the rate of the coastal accretion. It has been found that the pressure equalization modules create a natural equilibrium profile with a system of about 1:20, so that the waves run up on the beach and leave material, as water in motion can carry large amounts of material which settle when the velocity of the water decreases. The profile must therefore have a given width with respect to the tide and a maximum water level in the area. Coastal profiles with pressure equalization modules naturally become very wide, which results in a very great sand drift on the foreshore. This great sand drift is utilized by establishing longitudinal fascines high up in the beach and transverse fascines with an increasing height toward the foot of the dune, the fascines forming the upper part of the beach profile.

The invention will be described more fully below with reference to the accompanying drawings.

DETAILED DESCRIPTION OF THE PREFERRED EMBODIMENTS

Figure 1:
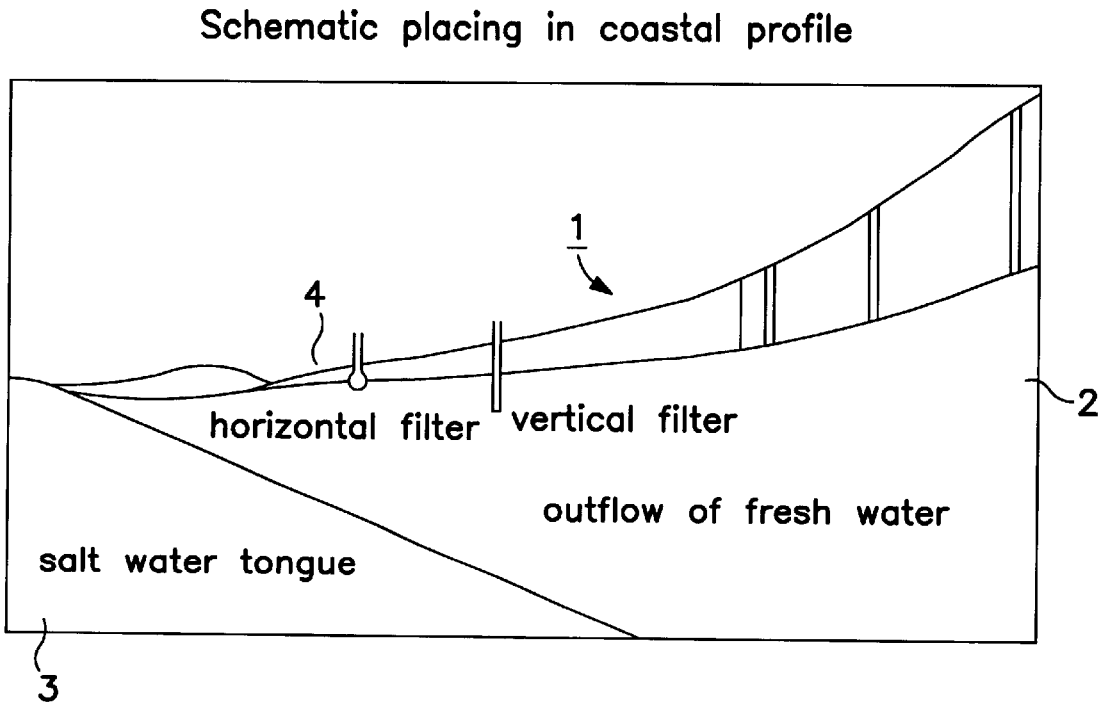
FIG. 1 shows a cross-section through a coastal profile.

As shown in FIG. 1, a freshwater basin is present below a coastal profile 1, and this freshwater basin is defined at the bottom in a downwardly inclined plane by a tongue of salt water 3 which has a greater density than freshwater.

The reason for coastal erosion is thus that when the freshwater below the beach profile is under pressure, the salt water seeping down into the profile runs back into the sea on top of the freshwater 2, as shown in FIG. 1. When the pressure of the freshwater decreases, the salt water seeps down through the material in the coastal profile and is mixed with the freshwater and thus does not erode the coastal profile, but, instead, material settles on the beach.

Figure 2:
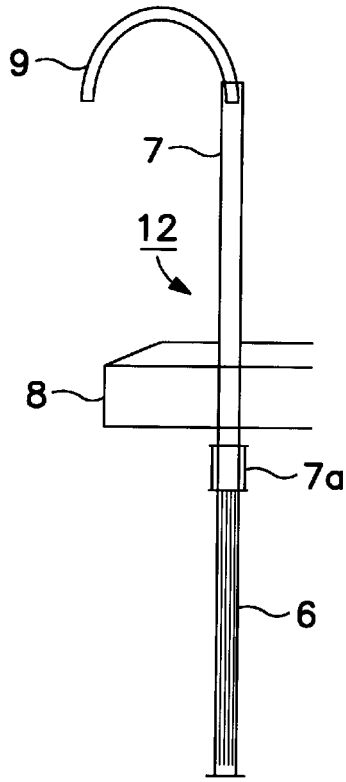
FIG. 2 shows a pressure equalization module intended to be positioned on the beach.

As shown in FIG. 2, the pressure equalization modules may consist of a rigid filter pipe 6 which is connected to a pipe 7 having a sleeve 7*a*. The filter and the pipe may thus be pressed, flushed or dug into the freshwater basin 2. Preferably, the pipe 7 has a length such that it protrudes slightly above the surface of the coastal profile 1 when the filter is in position in the freshwater basin. The pipes with filters, as shown in FIG. 2, are arranged in a row in a line which is perpendicular or approximately perpendicular to the shore line. The pipe 7 is open at the top so as to create good hydraulic contact down to the freshwater basin.

Figure 3:
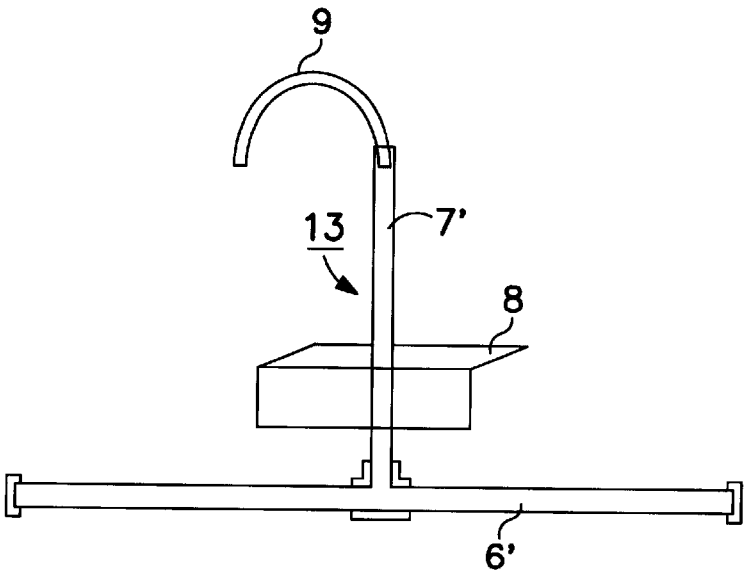
FIG. 3 shows a pressure equalization module intended to be positioned in the swash zone.

When the pressure in the freshwater basin has been equalized by means of the pressure equalization modules 12, the sedimentation of material on the stretch of coast may be accelerated according to the invention by establishing further pressure equalization modules 13 in the swash zone 4. An expedient arrangement of a module to be positioned in this zone is shown in FIG. 3 and comprises a rigid pipe 7' connected with a horizontal filter pipe 6'.

In both cases, the modules are provided with an anchoring element 8 intended to be dug into the sand to prevent unauthorized removal of the modules. The anchoring element is in the form of two angled plate elements secured to the rigid pipe. Furthermore, the pipe end, which protrudes from the sand, is provided with a curved termination 9 to prevent unauthorized filling of the pipe with sand, stone, etc. Optionally, the pressure equalization modules may be connected with dug pipes which are run to the foot of the dune where free communication with the atmosphere is created, thereby avoiding protruding pipe stubs.

The use of such pressure equalization modules on a stretch of coast has resulted in a land reclamation of a width of 4–6 metres and an increase in the coastal profile of 60–70 cm in 40 days.

Figure 4:
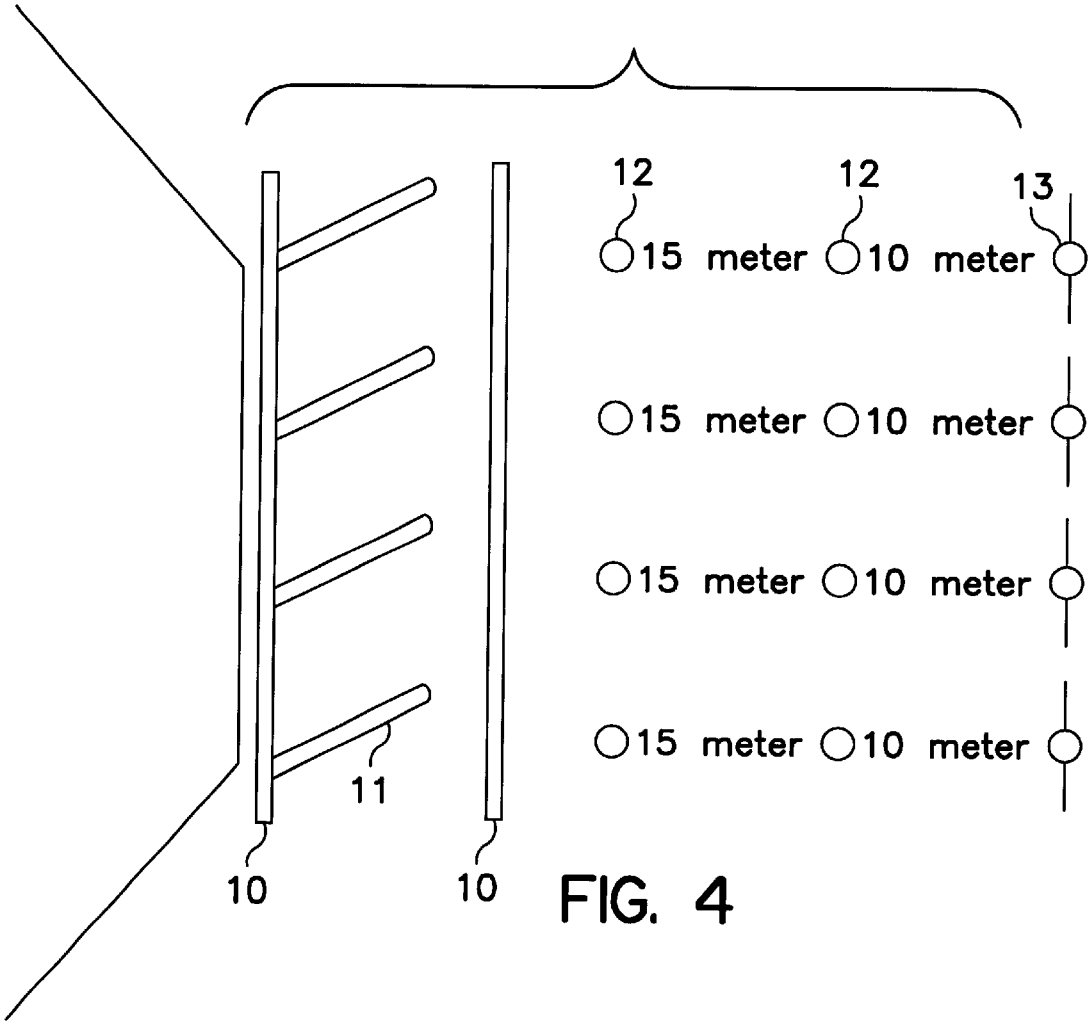
FIG. 4 shows a stretch of coast seen from above with pressure equalization modules and fascines.
Figure 5:
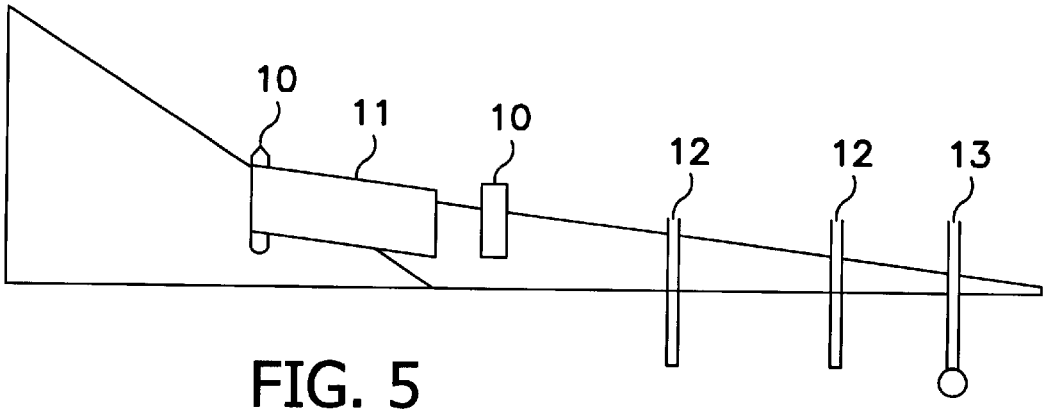
FIG. 5 shows a coastal profile in the stretch of coast in FIG. 4.

Coastal profiles with pressure equalization modules naturally become very wide, as mentioned, which results in a great sand drift on the foreshore. As will appear from FIGS. 4 and 5, this great sand drift is utilized by establishing longitudinal fascines 10 high up in the beach and transverse fascines 11 of an increasing height toward the foot of the dune. The upper part of the beach profile may be given the desired shape by adapting the length, orientation and height of the fascines. The fascines may, e.g., be formed by brushwood of pine and spruce or the like dug into the coastal profile or stacked between buried piles, which makes it easy to give the fascines the desired shape.

The invention is unique by low costs of construction and operation, the cost of operation involving merely ordinary inspection and maintenance of the systems.

New research in the field has documented that the groundwater pressure on a coastal profile is very decisive for its appearance. It has been demonstrated that coastal profiles having a high freshwater pressure become narrow and concave (also called winter profile), while coastal profiles without noticeable freshwater pressure become wide and convex (also called summer profile). Narrow, concave coastal profiles having a high freshwater pressure are seen in Denmark typically at Vejby Strand on the north coast of Zealand and south of Lønstrup at Mårup Kirke.

Narrow, concave coastal profiles are greatly exposed to erosion, while wide, convex coastal profiles have beach accretion. With the invention, as described, it is possible to convert a narrow, concave coastal profile into a wide, convex coastal profile and thereby to protect the coast.

What is claimed is:

1. A method for protecting a coastal area which includes a beach area that meets salt water at a shoreline, and where a freshwater basin underlies the coastal area and a salt water tongue extends below the freshwater basin at an oblique angle, the method comprising extending at least one pipe downwardly in the beach area near the shoreline so as to reach the freshwater basin and communicate the freshwater basin with the atmosphere such that at least a partial equalization of a pressure in the freshwater basin with a pressure of the atmosphere is achieved in said beach area by means of said communication.

2. A method according to claim 1, wherein said at least one pipe includes a filter in a part thereof that extends into the freshwater basin.

3. A method according to claim 1, wherein a plurality of pipes are extended downwardly through the beach to the fresh water basin at a distance from the shoreline.

4. A method according to claim 3, wherein, said coastal area also defines a swash zone adjacent said shoreline, and including placing a plurality of additional said pipes in said swash zone to communicate with said freshwater basin.

5. A method according to claim 1 wherein fascines are provided on the coastal area.

6. A method according to claim 1, wherein said at least one pipe includes an anchoring element.

7. A method according to claim 6, wherein said at least one pipe has a pipe stub which protrudes upwardly from the coastal area and a downwardly bent extension attached to the stub which includes an aperture facing downwardly and which defines an upper free end of the pipe.

* * * * *